US008260606B2

(12) United States Patent
Setiawan et al.

(10) Patent No.: US 8,260,606 B2
(45) Date of Patent: Sep. 4, 2012

(54) METHOD AND MEANS FOR DECODING BACKGROUND NOISE INFORMATION

(75) Inventors: Panji Setiawan, München (DE); Stefan Schandl, Vienna (AT); Herve Taddei, Bonn (DE)

(73) Assignee: Siemens Enterprise Communications GmbH & Co. KG, Munich (DE)

( * ) Notice: Subject to any disclaimer, the term of this patent is extended or adjusted under 35 U.S.C. 154(b) by 180 days.

(21) Appl. No.: 12/867,791

(22) PCT Filed: Feb. 2, 2009

(86) PCT No.: PCT/EP2009/051120

§ 371 (c)(1),
(2), (4) Date: Aug. 16, 2010

(87) PCT Pub. No.: WO2009/103609

PCT Pub. Date: Aug. 27, 2009

(65) Prior Publication Data

US 2011/0040560 A1 Feb. 17, 2011

(30) Foreign Application Priority Data

Feb. 19, 2008 (DE) ..... 10 2008 009 720

(51) Int. Cl.
*G10L 19/00* (2006.01)
*G10L 11/02* (2006.01)

(52) U.S. Cl. ..... 704/201; 704/215; 704/228

(58) Field of Classification Search ..... 704/201, 704/210, 215, 228
See application file for complete search history.

(56) References Cited

U.S. PATENT DOCUMENTS

| | | | | |
|---|---|---|---|---|
| 6,631,139 | B2 * | 10/2003 | El-Maleh et al. | 370/466 |
| 7,912,712 | B2 * | 3/2011 | Shlomot et al. | 704/226 |
| 8,032,359 | B2 * | 10/2011 | Shlomot et al. | 704/201 |
| 2006/0293885 | A1 | 12/2006 | Gournay et al. | |
| 2008/0195383 | A1 * | 8/2008 | Shlomot et al. | 704/205 |
| 2009/0306992 | A1 * | 12/2009 | Ragot et al. | 704/500 |

FOREIGN PATENT DOCUMENTS

WO 2007064256 A2 6/2007

OTHER PUBLICATIONS

Setiawan et al. "On the ITU-T G.729.1 Silence Compression Scheme," 16th European Signal Processing Conference (EUSIPCO 2008), Switzerland, Aug. 25-29, 2008, pp. 1-5.*

International Preliminary Report on Patentability for PCT/EP2009/051120 (Form PCT/IB/326, PCT/IB/373, PCT/ISA/237) (German Translation), Sep. 7, 2010.

(Continued)

*Primary Examiner* — James Wozniak
(74) *Attorney, Agent, or Firm* — Buchanan Ingersoll & Rooney PC

(57) ABSTRACT

A basic idea of the invention is to ascertain information on the course of the bit rate switching during an active speech phase. According to the invention, during the speech phase, information on the percentage proportion of broadband active speech frames in comparison to narrowband active speech frames is compiled on the part of the decoder. A high percentage proportion of broadband active speech frames indicates that a broadband use is preferred on the part of the codec and therefore a need exists for synthesizing noise information in broadband form during a DTX phase.

13 Claims, 3 Drawing Sheets

OTHER PUBLICATIONS

International Preliminary Report on Patentability for PCT/EP2009/051120 (Form PCT/IB/338, PCT/IB/373, PCT/ISA/237) (English Translation) Sep. 7, 2010.

Written Opinion of the International Searching Authority for PCT/EP2009/051120 (Form PCT/ISA/237) (English Translation) Sep. 7, 2010.

International Search Report for PCT/EP2009/051120 dated Jul. 15, 2009 (Form PCT/ISA/210) (German and English Translation).

International Telecommunication Union ITU-T, "Series G: Transmission Systems and Media, Digital Systems and Networks", Jun. 1, 2008, Nr. G:729.1, pp. 1-36.

Sollaud, "G.729.1 RTP Payload Format Update: DTX Support", Feb. 8, 2008.

Sollaud, "G.729.1 RTP Payload Format Update: DTX Support", Jan. 14, 2008.

Sollaud, "G.729.1 RTP Payload Format Update: Discontinuous Transmission (DTX) Support", Jan. 2009.

* cited by examiner

METHOD AND MEANS FOR DECODING BACKGROUND NOISE INFORMATION

CROSS-REFERENCE TO RELATED APPLICATIONS

This application is the United States national phase under 35 U.S.C. §371 of PCT International Patent Application No. PCT/EP2009/051120, filed on Feb. 2, 2009, and claiming priority to German National Application No. 10 2008 009 720.9, filed on Feb. 19, 2008. Those applications are incorporated by reference herein.

BACKGROUND OF THE INVENTION

1. Field of the Invention

Embodiments are directed to methods and means for decoding background noise information in speech signal encoding methods.

2. Background of the Related Art

Since the beginnings of telecommunication, a limitation of bandwidth for analog voice transmission has been designated for telephone calls. Voice transmission takes place at a limited frequency range of 300 Hz to 3400 Hz.

Such a limited range of frequencies is also designated in many voice signal encoding methods for present-day digital telecommunications. To this end, prior to any encoding procedure, the analog signal's bandwidth is delimited. In the process, a codec is used for coding and decoding, which, because of the described delimitation of its bandwidth between 300 Hz and 3400 Hz, is also referred to as a narrowband speech codec in the following text. The term codec is understood to mean both the coding requirement for digital encoding of audio signals and the decoding requirement for decoding data with the goal of reconstructing the audio signal.

One example of a narrowband speech codec is known as the ITU-T Standard G.729. The transmission of a narrowband speech signal having a bit rate of 8 kbit/s is provided using the coding requirement described therein.

Moreover, so-called wideband speech codecs are known, which provide encoding in an expanded frequency range for the purpose of improving the auditory impression. Such an expanded frequency range lies, for example, between a frequency of 50 Hz and 7000 Hz. One example of a wideband speech codec is known as the ITU-T Standard G.729.EV.

Customarily, encoding methods for wideband speech codecs are configured so as to be scalable. Scalability is here taken to mean that the transmitted encoded data contain various delimited blocks, which contain the narrowband component, the wideband component, and/or the full bandwidth of the encoded speech signal. Such a scalable configuration, on the one hand, allows downward compatibility on the part of the recipient and, on the other hand, in the case of limited data transmission capacities in the transmission channel, makes it easy for the sender and recipient to adjust the bit rate and the size of transmitted data frames.

To reduce the data transmission rate by means of a codec, customarily the data to be transmitted are compressed. Compression is achieved, for example, by encoding methods in which parameters for an excitation signal and filter parameters are specified for encoding the speech data. The filter parameters as well as the parameter that specifies the excitation signal are then transmitted to the receiver. There, with the aid of the codec, a synthetic speech signal is synthesized, which resembles the original speech signal as closely as possible in terms of a subjective auditory impression. With the aid of this method, which is also referred to as the "analysis by synthesis" method, the samples that are established and digitized are not transmitted themselves, but rather the parameters that were ascertained, which render a synthesis of the speech signal possible on the receiver's side.

A method for discontinuous transmission, which is also known in the field as DTX, affords an additional way to reduce the data transmission rate. The fundamental goal of DTX is to reduce the data transmission rate when there is a pause in speaking.

To this end, the sender employs speech pause recognition (Voice Activity Detection, VAD), which recognizes a speech pause if a certain signal level is not met.

Customarily, the receiver does not expect complete silence during a speech pause. On the contrary, complete silence would lead to annoyance on the receiver's part or even to the suspicion that the connection had been interrupted. For this reason, methods are employed to produce a so-called comfort noise.

A comfort noise is a noise synthesized to fill phases of silence on the receiver's side. The comfort noise serves to foster a subjective impression of a connection that continues to exist without requiring the data transmission rate that is used for the purpose of transmitting speech signals. In other words, less energy is expended for the sender to encode the noise than to encode the speech data. To synthesize—i.e., decode—the comfort noise in a manner still perceived by the receiver as realistic, data are transmitted at a far lower bit rate. The data transmitted in the process are also referred to within the field as SID (Silence Insertion Descriptor).

In the current state of the art, problems exist with the method for discontinuous transmission using wideband speech codecs, such as ITU-T G.729.1, G.722.2 or 3GPP AMR-WB, for example. The speech codecs referred to as scalable wideband typically support different data transmission rates in a wideband range of 50 to 7000 Hz.

Possible bit rates for encoding speech information are, for instance, 8, 12, 14, 16, . . . , 32 kbit/s, which are used in Standard G.729.1, for example. The bit rates of 8 and 12 kbit/s are applied in narrowband signals (50 Hz to 4 kHz). Bit rates of more than 12 kbit/s are applied to the upper spectrum of 4 to 7 kHz.

A change between the aforementioned bit rates is possible during a transmission. A sudden change from a narrowband to a wideband bit rate is known to cause a disturbing effect to a human recipient. For instance, such a transition takes place in the sequence of a bitstream truncation, which can be caused by a transfer network between the sender and receiver, for example, in the sequence of establishing additional connections or due to congestion in the transfer network. This truncation leads to a change in the bit rate and finally to a transition from wideband to narrowband transfer of the speech signal.

If the discontinuous transmission or DTX method is used in the encoder method, a reduction of the data transmission rate for transmission of the respective data frame is possible. The DTX method is used precisely when a corresponding frame is characterized as a speech pause. Use of the DTX method achieves a reduced data transmission rate of the transmitted frame due to two factors. First, on the side of the encoder, all inactive frames do not have to be sent to the decoder. Second, a sent SID frame or inactive frame uses far fewer bits than a speech data frame.

Such a method requires involvement of voice activity detection (VAD) on the encoder side. By means of a voice activity detector, the encoder is informed as to whether a frame containing a current sampling rate and to be encoded contains a speech signal or a speech pause with background noise. Use of this characterization affects encoder actions, which ascertain the perceptional characteristics of an inactive speech frame. Such perceptional characteristics include the energy transmitted, for instance, as well as spectral and temporal characteristics.

The encoder sends a specially identified frame, an SID (Silence Insertion Descriptor) frame, to the decoder. The decoder synthesizes a comfort noise based on the information contained in the SID frame, in which the decoder can determine whether the noise information contained involves narrowband or wideband information based on the SID frame.

A change in the bit rate (Bit Rate Switching) between narrowband and wideband information is a typical scenario for every scalable wideband speech codec. Handling a bit rate switch during a normal speech phase, i.e., in the absence of speech pauses, is amply described in the literature, but handling one during entry into a DTX phase is still not yet known at this time. Therefore, an urgent need exists to provide a method for bit rate switching during a DTX phase and/or during entry into a DTX phase in order to optimally respond to a switch between a narrowband and wideband bit rate before or during the transition into the DTX phase.

During a speech pause, a truncation of the bit rate is unlikely, because the bitstream relocation of an SID frame needs fewer bits as it is than an active speech data frame in a "normal" codec operation, i.e., a codec operation during an exclusively speaking phase.

This leads to a possible scenario in which the bit rate is changed during an active speaking phase, but in speech pauses, i.e., during the DTX phase, remains in a wideband mode. Because this can be very disturbing to the human recipient on the decoder side, it is recommended in this case that the active speaking frames be decoded in narrowband and the background noise be rendered in the speech pauses in wideband.

This is more likely to occur, for instance, in situations in which the speech data frame sent on the encoder end is truncated by the transmission network, while on the side of the transmission network, there is still sufficient capacity remaining for transmission of the wideband SID frame.

As yet, no method for switching the bit rate of the SID frame during a speech pause is known. The existing method for bitstream switching applies solely to normal codec operation during an active speaking phase.

BRIEF SUMMARY OF THE INVENTION

Embodiments of the invention provide a method for bitstream switching of SID frames during a speech pause that results in improved quality of the signal synthesized by the decoder.

A basic idea of the invention is to ascertain information in the course of the bit rate switching during an active speech phase. The scalable nature of the invented method for use in speech signal encoding methods and codecs has already shown the feasibility of the codec for bit rate switching.

According to embodiments of the invention, during the speech phase, information on the percentage proportion of wideband active speech frames is collected in comparison to the narrowband active speech frames on the decoder side. In other words, the information on the nature of the background noise in a speech pause is not collected for the first time at the point of the switch, as has been suggested by the state of the art to this point. A higher percentage proportion of wideband active speech frames shows thereby that wideband use on the side of the codec is preferable, and therefore a need exists to synthesize, i.e., decode, wideband noise information during a DTX phase. In contrast, if a lower percentage proportion is determined, narrowband noise will be generated by the decoder upon entry into a DTX phase, even when the received SID frame would have allowed the synthesis—i.e., decoding—of wideband noise.

With this method the intent of certain embodiments of the invention—to provide a method for bitstream switching of SID frames during a speech pause—is more than solved. The intent to be achieved of switching between noise information with different bit rates is improved, according to the invented solution presented here, by determining a proportion of noise information with different bit rates. The proportion is variable, in contrast to a switch, in any ratio between noise information with different bit rates.

Due to the variability and adaptability of the noise signal quality with respect to the previously collected speech signal quality (narrowband/wideband), the total resulting signal, that is, noise and speech signal, is considerably increased overall on the side of the receiver. Embodiments therefore may achieve an improved quality of the signal synthesized on the decoder.

Such an approach according to the invented method proves to be the foundation for advantageous further embodiments of the invention, which are the object of the subordinate claims.

If, according to the invented method, a decision is made to the effect that during a speech pause, a noise signal of a certain quality (i.e., wideband or narrowband) is synthesized, it can result that the active data frame is truncated on the side of the network in the last few frames during an active speech phase.

For clarification, it is initially assumed that the codec applied favors a wideband rendering mode and a wideband transmission mode also was predominantly provided through the transmission network. This can lead to the case that few active speech frames arrive as narrowband speech frames at the receiving decoder, before the first SID frames are received there.

In this case, without additional measures, an abrupt transition from the narrowband speech signal to a wideband noise signal occurs during the first few SID frames. However, such a transition for returning to a wideband receiver status is so significant that this transition is generally considered disturbing to the receiver.

A further embodiment of the invention provides that, on entering into the DTX phase, initially predominantly narrowband decoding of the background noise information occurs, which is converted after a variable time period into predominantly wideband decoding. Such a transition occurs preferably quasi-continuously, with a transition adjusted to a specified proportional factor at discrete time points—which is why it is "quasi"-continuous.

According to a further embodiment of the invention, a method for fast switching is proposed in which a quasi-continuous transition from a narrowband (proportional factor=0) to a wideband (proportional factor=1) noise signal quality is carried out within a set time frame of 100 ms.

This transition is carried out on the side of the decoder.

The following values for the proportional factor have proven to be particularly advantageous for subjective human hearing, according to a further embodiment of the invention:

A proportional factor of 0 for the time point of entry into the DTX phase, therefore exclusively narrowband noise;

A proportional factor of 0.09525986892242 for a time point 20 ms after entry into the DTX phase;

A proportional factor of 0.19753086419753 for a time point 40 ms after entry into the DTX phase;

A proportional factor of 0.36595031245237 for a time point 60 ms after entry into the DTX phase;

A proportional factor of 0.62429507696997 for a time point 80 ms after entry into the DTX phase; and;

A proportional factor of 1, therefore exclusively wideband signal, for a time point 100 ms after entry into the DTX phase.

According to a further embodiment of the invention, it is assumed that the codec used favors a narrowband rendering mode and/or a wideband transmission mode not allowed by the transmission network in the past. This can lead to the case that fewer active speech frames arrive as broadband speech frames at the receiving decoder before the first SID frames are received.

According to a further embodiment of the invention, it is provided that on entry into the DTX phase, initially predominantly wideband decoding of the background noise information takes place, which is converted into predominantly narrowband decoding after a variable amount of time. Such a transition takes place, preferably quasi-continuously, in a manner similar to the above-described further embodiment, in which a transition to discrete time points is adjusted to a specified proportional factor.

According to a further embodiment of the invention, a method for fast switching is proposed in which a quasi-continuous transition from wideband (proportional factor=1) to narrowband (proportional factor=0) noise signal quality is carried out within a specified time period of 100 ms. This transition is carried out on the side of the decoder.

For the quasi-continuous transition from wideband to narrowband noise signal quality, the proportional factor has values as above, but set in reverse order.

An embodiment example with additional advantages and configurations of the invention is illustrated in greater detail in the following by means of the drawing.

DETAILED DESCRIPTION OF THE INVENTION

Figure 1:
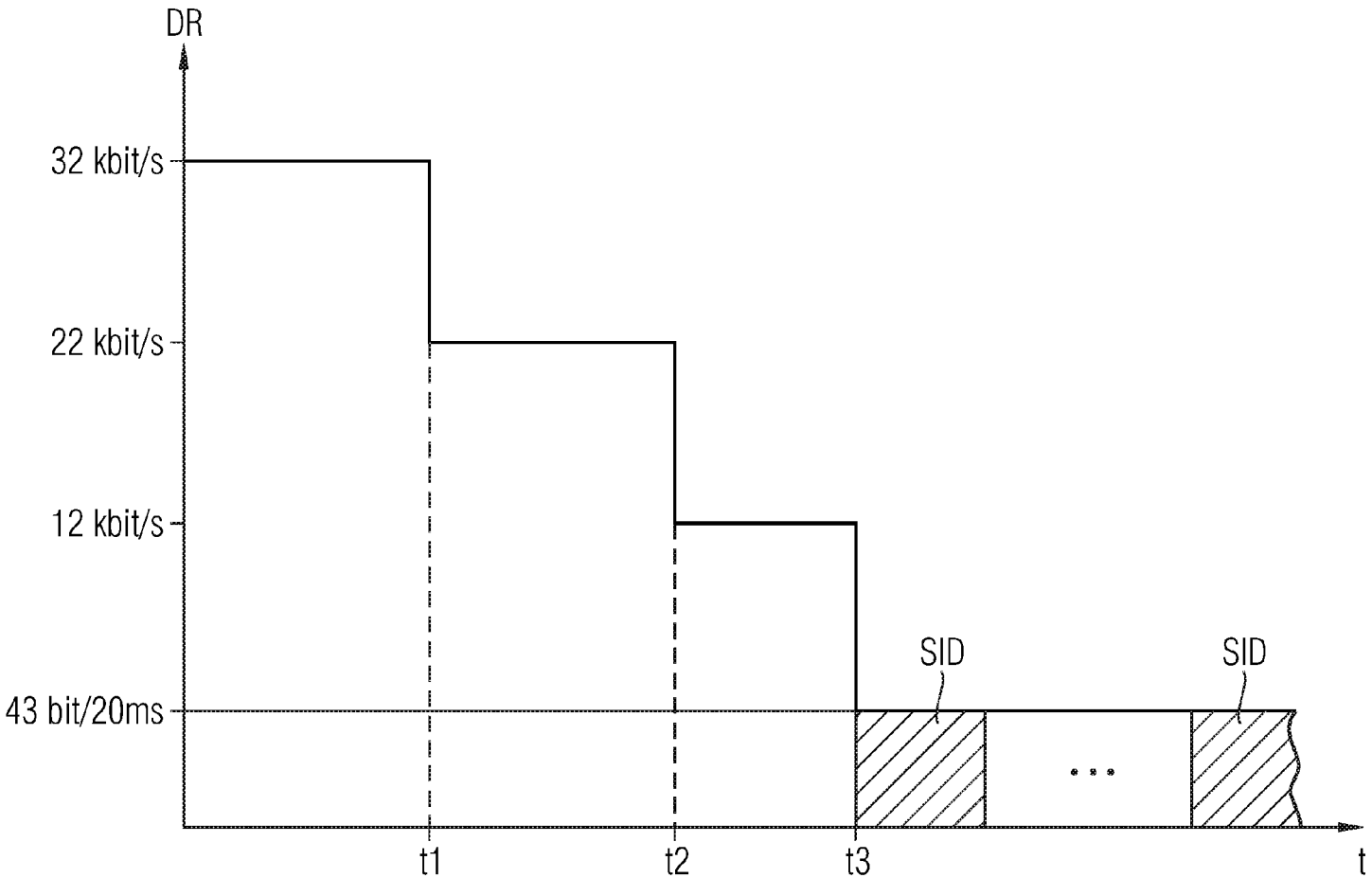
FIG. 1: a temporal representation of a bit rate between a sender and a receiver with several wideband switches and an entry into a speech pause, where SID frames are sent.

In FIG. 1, a temporal transmission from speech data frames with a respective data rate DR (bit rate) as well as, after a third time point t3, a transmission from SID frames is shown. Prior to a first time point t1, a transmission from wideband active speech frames with a bit rate of 32 kbit/s takes place. After time t1, a switch to a bit rate of 22 kbit/s takes place and after a second time t2 to a bit rate of 12 kbit/s. A bit rate of 12 kbit/s corresponds already to a narrowband speech frame.

At a third time t3, it is assumed that a transfer occurs in a DTX phase based on a speech pause on the side of the sender. After the third time t3, consequently SID frames SID are sent in specified time periods.

After the third point t3, the situation previously explained commences: that in the past, during the phase of time between the second time t2 and the third time t3, a narrowband speech signal was transmitted, and after the third time point t3, from that point on a wideband noise signal is provided through the corresponding SID frame. The bit rate of the SID frame corresponds to 43 bit/20 ms=2.15 kbit/s at a length of 43 bits per SID frame and a period of 20 ms per SID frame sent.

In this situation, the case occurs that on the decoder side an immediate, i.e., discontinuous, transition from a narrowband speech signal to a wideband noise signal will take place. Such an abrupt transition is perceived by a human recipient as acutely disturbing.

Figure 2A:
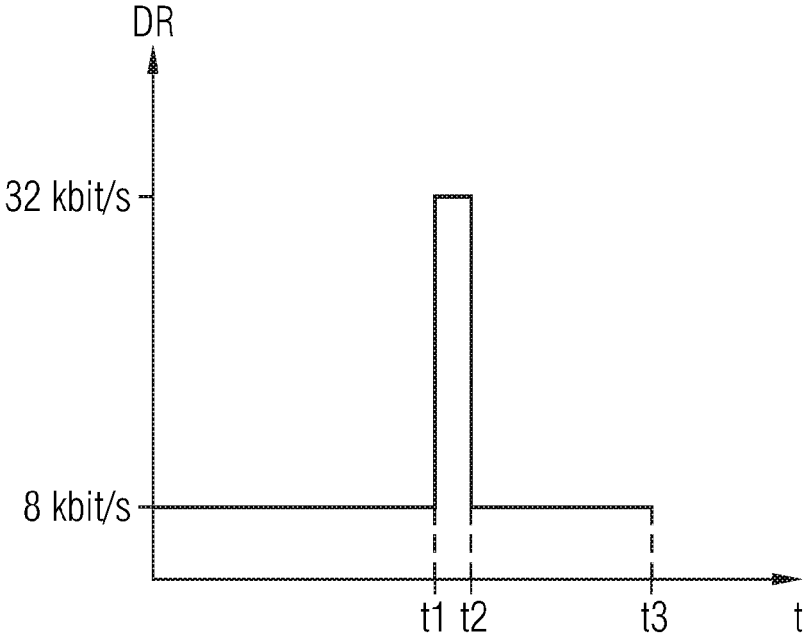
FIG. 2A: a schematic representation of a first bit rate switching scenario.
Figure 2B:
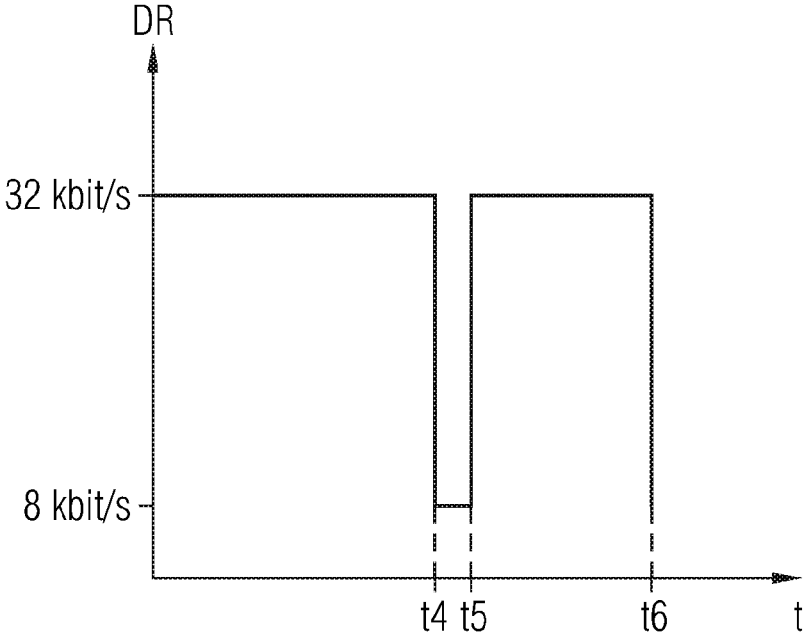
FIG. 2B: a schematic representation of a second bit rate switching scenario.

FIGS. 2A and 2B show two possible scenarios for progression of the data rate DR (bit rate) over the time t.

In FIG. 2A, based on the limitations of the network or based on other circumstances, transmission is largely narrowband, for example in FIG. 2A with 8 kbit/s, while a few times between a first time t1 and a second time t2, wideband transmission occurs exceptionally at 32 kbit/s.

In FIG. 2B, on the other hand, the reverse situation is noted, namely a predominantly wideband transmission mode at 32 kbit/s and an exceptional short narrowband transmission mode occurring between a fourth time t4 and a fifth time t5.

In the following, it is assumed that entry into a DTX phase occurred at a time t3 for the example of FIG. 2A as well as a time t6 for the example of FIG. 2B.

According to embodiments herein, during the speech phase on the side of the decoder, information on the proportion of wideband active speech frames is collected in comparison to the narrowband active speech frame.

For the example of FIG. 2A, the percentage proportion of wideband active speech frames is identified as very low, while in the example of FIG. 2B, a higher percentage proportion of wideband active speech frames is present.

On entering into a DTX phase at time t3 in the FIG. 2A example, narrowband noise is generated by use of the invented method, although the SID frame received—not shown—after time t3 would allow the synthesis of wideband noise.

In the FIG. 2B example, in contrast, wideband synthesis of the noise information is preferred at the DTX phase, beginning there at the time t6.

Figure 3:
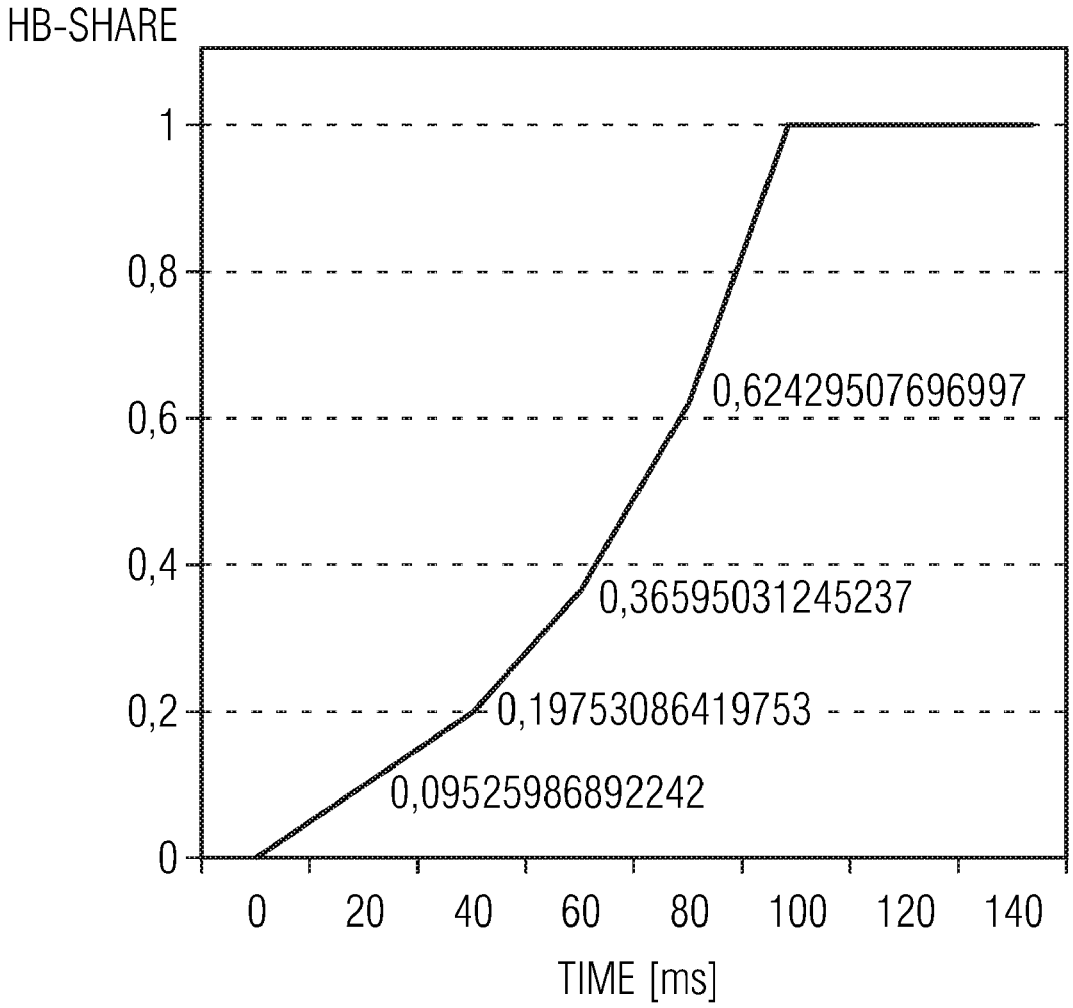
FIG. 3: a switching process performed on the decoder side with a quasi-continuous transition from narrowband to wideband noise signal quality.

In FIG. 3, a noise signal quality HB-SHARE is plotted over a time TIME, provided in ms. FIG. 3 shows a configuration of the noise signal according to a scenario as in the previous FIG. 2B, in which a requirement was calculated to synthesize noise information during the DTX phase based on the calculated percentage proportion of wideband active speech frames.

The transition into the DTX phase occurs at the time TIME of 0 ms shown in the drawing of FIG. 3. In order to configure this transition from a narrowband speech signal to a quasi-continuous wideband noise signal, which has been proven to be the best configuration for subjective auditory perception of a human recipient, an exclusively narrowband signal is begun at this time TIME, i.e., with a proportion HB-SHARE of the wideband noise of 0. At a time of 100 ms, the wideband proportion is 1 or 100%. In practice, the following values of the proportion HB-SHARE at the discrete times TIME have been established for the quasi-continuous transition from an exclusively narrowband noise signal at a time TIME of 0 ms to an exclusively wideband noise signal at a time TIME of 100 ms:

A proportion HB-SHARE of 0.09525986892242 at the time TIME of 20 ms;

A proportion HB-SHARE of 0.19753086419753 at the time TIME of 40 ms;

A proportion HB-SHARE of 0.36595031245237 at the time TIME of 60 ms; and

A proportion HB-SHARE of 0.62429507696997 at the time TIME of 80 ms.

Another embodiment of the invention provides a transition from a wideband speech signal to a narrowband noise signal in a similar manner.

For this purpose, a scenario is assumed which is slightly modified in reference to FIG. 2A, in which the deviation from the scenario shown in FIG. 2A is shortly before time t3 where one more change to a wideband transmission—not shown—takes place at 32 kbit/s. Despite this "Peak," the percentage proportion of wideband active speech frames stays very low, so that now at the transition into the DTX phase, a noise signal remains to be synthesized that begins as wideband but—based on the predominantly narrowband transmission history and the fact that narrowband transmission is expected to continue in the future—is to be transferred as a narrowband noise signal. In order for this transition from a wideband speech signal to a narrowband noise signal to be configured quasi-continuously, entry into the DTX phase is begun with an exclusively wideband signal, i.e., with a proportion HB-SHARE of the wideband noise of 1. At the time of 100 ms, the narrowband noise proportion is 0. In order for the quasi-continuous transition of an exclusively wideband noise signal at the time of entry into the DTX phase to an exclusively narrowband noise signal at a time after 100 ms, the proposed values above are advantageously adapted in reverse order. This would correspond to a curve mirrored to the ordinate HB-SHARE in FIG. 3.

The invention claimed is:

1. A method for decoding a Silence Insertion Descriptor (SID) frame for transmission of background noise information by use of a scalable speech signal encoding method, comprising:

determining a percentage proportion of received wideband speech frames in relation to received narrowband speech frames during a speech pause, and decoding background noise information contained in the SID frame on entry into a discontinuous transmission (DTX) phase, wherein the decoding takes place according to the determined percentage proportion.

2. The method of claim 1, comprising performing predominantly wideband decoding when a high percentage proportion of wideband speech frames is determined to be received on entry into the DTX phase.

3. The method of claim 2, comprising on entry into the DTX phase, initially performing predominantly narrowband decoding of background noise information and converting said predominantly narrowband decoding into predominantly wideband decoding after a variable time period.

4. The method of claim 3, comprising varying said variable time period by a proportional factor which expresses a ratio between wideband and narrowband noise signal quality.

5. The method of claim 4, comprising scaling the proportional factor to zero at a time of the entry into the DTX phase.

6. The method of claim 5 comprising scaling the proportional factor to 1 at a time of 100 ms after entry into the DTX phase.

7. The method of claim 4, comprising scaling the proportional factor to a value and at a time selected from the group consisting of:

to 0.09525986892242 at a time of 20 ms after entry in the DTX phase;

to 0.19753086419753 at a time of 40 ms after entry in the DTX phase;

to 0.36595031245237 at a time of 60 ms after entry in the DTX phase; and to 0.62429507696997 at a time of 80 ms after entry in the DTX phase.

8. The method of claim 1, comprising when a smaller proportion of wideband speech frames is determined to be received on entry into the DTX phase, performing predominantly narrowband decoding of background noise information.

9. The method of claim 8, comprising on entry into the DTX phase, initially performing predominantly wideband decoding of the background noise information, and, after a variable time period, transitioning into predominantly narrowband decoding.

10. The method of claim 9, wherein the transition to predominantly narrowband decoding is variable with a proportional factor which expresses a ratio between wideband and narrowband noise signal quality.

11. The method of claim 10, comprising scaling the proportional factor to one at a time of entry into the DTX phase.

12. The method of claim 11, comprising scaling the proportional factor to zero at a time of 100 ms after entry into the DTX phase.

13. The method of claim 10, comprising scaling the proportional factor to a value and at a time selected from the group consisting of:

to 0.62429507696997 at a time of 20 ms after entry into the DTX phase;

to 0.36595031245237 at a time of 40 ms after entry into the DTX phase;

to 0.19753086419753 at a time of 60 ms after entry into the DTX phase; and to 0.09525986892242 at a time of 80 ms after entry into the DTX phase.

* * * * *